US006655999B2

(12) United States Patent
Mase et al.

(10) Patent No.: US 6,655,999 B2
(45) Date of Patent: Dec. 2, 2003

(54) CONNECTOR AND A METHOD OF ASSEMBLING IT

(75) Inventors: Tsuyoshi Mase, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/175,241

(22) Filed: Jun. 18, 2002

(65) Prior Publication Data

US 2002/0193012 A1 Dec. 19, 2002

(30) Foreign Application Priority Data

Jun. 18, 2001 (JP) ..... 2001-183996

(51) Int. Cl.[7] ..... H01R 13/514
(52) U.S. Cl. ..... 439/752; 439/595
(58) Field of Search ..... 439/752, 595, 439/352

(56) References Cited

U.S. PATENT DOCUMENTS 615,588 A * 12/1898 Taylor ..... 172/511
5,326,287 A * 7/1994 Hamakita et al. ..... 439/752
5,647,774 A * 7/1997 Yamamoto ..... 439/752
5,692,929 A * 12/1997 Hoffmann ..... 439/752
5,746,628 A * 5/1998 Yamamoto ..... 439/752
5,980,331 A * 11/1999 Matsushita et al. ..... 439/752
6,261,133 B1 * 7/2001 Kubo et al. ..... 439/752
6,443,781 B2 * 9/2002 Kubo ..... 439/752

FOREIGN PATENT DOCUMENTS

JP 64-054678 3/1989

* cited by examiner

*Primary Examiner*—Tho D. Ta
*Assistant Examiner*—Larisa Tsukerman
(74) *Attorney, Agent, or Firm*—Anthony J. Casella; Gerald E. Hespos

(57) ABSTRACT

Terminal fittings (30) are locked in a housing (10) by locks (13), but are permitted to shake along the terminal insertion direction (ID). A retainer (40) can be moved to a full locking position in the housing (10) and contacts the terminal fittings (30) to hold them at their proper insertion positions, thereby preventing them from shaking. Slanted contacts (36A, 41A) are provided so that the retainer (40) can push the terminal fittings (30) to their proper inserting positions even if the terminal fittings (30) initially are behind their proper insertion positions when the retainer (40) is moved to the full locking position.

7 Claims, 7 Drawing Sheets

CONNECTOR AND A METHOD OF ASSEMBLING IT

BACKGROUND OF THE INVENTION

1. Field of the Invention

The invention relates to a connector with a terminal fitting that is doubly locked by a retainer and to a method of assembling or mounting it.

2. Description of the Related Art

Japanese Unexamined Patent Publication No. 64-54678 discloses a connector that has a housing and a retainer that is movable in the housing from a partial locking position to a full locking position. Terminal fittings can be inserted into the housing when the retainer is at the partial locking position. The housing is formed with locks that engage the terminal fittings when the terminal fittings reach a properly inserted position. The retainer then is pushed to the full locking position and into engagement with the terminal fittings. Thus, the terminal fittings are locked doubly by the locks and the retainer.

The locks are cantilevered parallel with the inserting and withdrawing directions of the terminal fittings. However, free ends of the locks are displaced as the terminal fittings are inserted and describe a substantially arcuate trace. Thus, the locks come out of the insertion paths of the terminal fittings. The locks are restored resiliently when the terminal fittings reach their proper insertion positions, and the free ends of the locks engage the terminal fittings. Clearances necessarily are formed between the free ends of the locks and the terminal fittings when the terminal fittings are inserted properly. Further, the retainer locks the terminal fittings substantially at the same positions as the free ends of the locks. Thus, the terminal fittings may shake in the inserting and withdrawing directions due to the clearances between the free ends of the locks and the terminal fittings at their proper insertion positions.

This invention was developed in view of the above problem, and an object thereof is to suppress shaking of terminal fittings in inserting and withdrawing directions.

SUMMARY OF THE INVENTION

The invention relates to a connector with a housing and a retainer that can be moved from a partial locking position to a full locking position in the housing. At least one terminal fitting can be inserted into the housing when the retainer is in the partial locking position. The housing is formed with at least one lock that is displaced at an incline as the terminal fitting is inserted into the housing. The lock is restored resiliently when further movement in a terminal inserting direction is prevented. The resiliently restored lock engages the terminal fitting to lock the terminal fitting in the housing. The terminal fitting is locked, but is permitted to displace between the proper insertion position and a locking position that is spaced from the proper insertion position. The retainer then is moved to the full locking position and locks the terminal fitting by facing the terminal fitting from a terminal withdrawal side. The retainer comprises at least one pusher that engages the terminal fitting when the retainer is moved to the full locking position. The pusher contacts the terminal fitting from the terminal withdrawal side to hold the terminal fitting at its proper insertion position and to prevent the terminal fitting from shaking.

The retainer may be displaced in forward and backward directions with respect to the housing while the retainer is at the partial locking position. Alternatively, the retainer may be prevented from displacing or shaking in forward and backward directions with respect to the housing. In the latter case, the retainer is hardly moved forward and backward when being moved from the partial locking position to the full locking position. Thus, the retainer may be moved with the terminal fitting inserted to its proper insertion position.

The retainer and/or the housing may comprise displacing means for displacing the retainer at an angle, and preferably substantially forward, as the retainer is moved from the partial locking position to the full locking position.

At least one of the retainer and the terminal fitting may comprise a contact that obliquely contacts the other of the retainer and the terminal fitting as the retainer is moved from the partial locking position to the full locking position.

The lock permits the properly inserted terminal fitting to shake between the proper insertion position and the locking position. However, the retainer moves forward as it is advanced from the partial locking position to the full locking position and holds the terminal fitting at the proper insertion position. The contact of the retainer pushes the terminal fitting forward even if the terminal fitting is behind its proper insertion position when the retainer is moved to the full locking position.

The housing may comprise a receiving projection. The receiving projection has a partial locking receiving surface and a full locking receiving surface. The retainer preferably comprises a locking projection that has a partial locking surface and a full locking surface. Loose movement of the retainer from the partial locking position toward the full locking position is prevented by contact of the partial locking surface with the partial locking receiving surface. Loose movement of the retainer from the full locking position toward the partial locking position is prevented by contact of the full locking surface with the full locking receiving surface.

The retainer can be displaced forward as it is moved from the partial locking position to the full locking position. This displacement increases an engaged area of the receiving projection and the locking projection. An engaged area of the full locking receiving surface and the full locking surface is larger than an engaged area of the partial locking surface and the partial locking receiving surface. The increased engaged area holds the retainer at the full locking position more reliably and prevents inclination of the retainer.

The retainer preferably can make loose movements substantially along the terminal insertion direction with respect to the housing when arranged in the partial locking position whereas it substantially is prevented from making a loose movement when arranged in the full locking position.

Paired partial locking means preferably are provided at the opposite ends of the retainer with respect to a direction normal to a terminal inserting direction. The partial locking means of the retainer may engage receiving portions of the housing for preventing the retainer at the partial locking position from moving loosely toward the full locking position.

Spaced apart paired full locking means preferably are at the opposite ends of the retainer with respect to the direction normal to the terminal inserting direction. The pair of full locking means engage the receiving portions of the housing to prevent the retainer at the full locking position from moving loosely toward the partial locking position.

At least the partial locking means or the full locking means are provided at two positions spaced apart in a direction substantially parallel with the terminal inserting direction.

The invention also relates to a method for assembling or mounting a connector. The method comprises inserting at least one terminal fitting into a housing with a retainer mounted at a partial locking position in the housing. The terminal fitting is inserted until further movement in a terminal inserting direction is prevented. The terminal fitting is locked, but may displace between the proper insertion position and a locking position. The method then comprises moving the retainer at an angle to the terminal inserting direction from the partial locking position to a full locking position to lock the terminal fitting by facing the terminal fitting from a terminal withdrawal side. At least one pusher of the retainer is before a locking section of the lock and is engageable with the terminal fitting. The method comprises moving the retainer to the full locking position so that the pusher contacts the terminal fitting from the terminal withdrawal side for holding the terminal fitting at its proper insertion position and to prevent the terminal fitting from shaking.

The retainer preferably is permitted to displace at an angle to the retainer moving direction with respect to the housing while being held at the partial locking position.

The retainer moving step may comprise displacing the retainer forward by a displacing means of the retainer and/or the housing. The retainer moving step may comprise obliquely contacting at least one of the retainer and the terminal fitting with the other of the retainer and the terminal fitting.

The method further comprises a loose movement preventing step of preventing a loose movement of the retainer from the partial locking position toward the full locking position by contact of the partial locking surface with the partial locking receiving surface, and/or preventing a loose movement of the retainer from the full locking position toward the partial locking position by contact of the full locking surface with the full locking receiving surface.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with the invention has a housing 10 made e.g. of a synthetic resin, a front-stop 14 made e.g. of a synthetic resin, a plurality of terminal fittings 30, and a retainer 40 e.g. of a synthetic resin. In the following description, the side of the connector that mates with a mating connector (not shown) is referred to as front side.

Figure 1:
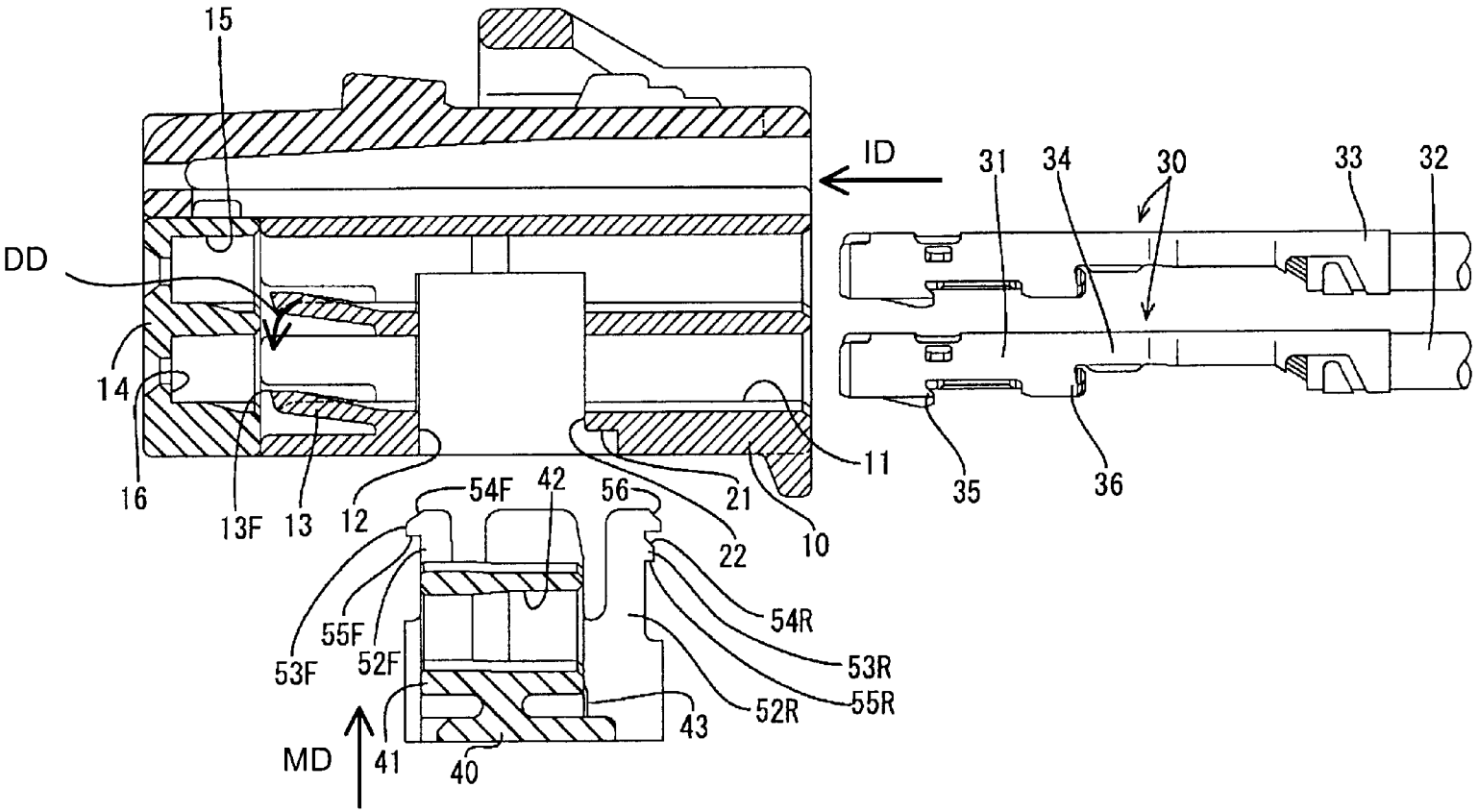
FIG. 1 is a section showing a state where terminal fittings and a retainer are detached from a housing in one embodiment of the invention.

Cavities 11 extend through the housing 10 from the front to the rear and are arrayed transversely at upper and lower stages. A retainer accommodating chamber 12 is open in the bottom surface of the housing 10 and communicates with the cavities 11. Resiliently deformable locks 13 are formed at locations in each cavity 11 between the retainer accommodating chamber 12 and the front end of the housing 10. Each lock 13 cantilevers forwardly from a bottom of the respective cavity 11 and has a front end 13F that projects into the respective cavity 11 when the lock 13 is in an unbiased locking position shown in FIG. 1. However, each lock 13 can be deflected resiliently about its rear end away from the respective cavity 11 and into a retracted position shown in chain line in FIG. 6. The front end 13F of each lock 13 moves obliquely forward and down in direction DD and traces an arc as the lock 13 is deflected into the retracted position. Thus, the front end 13F of the lock 13 moves toward the front end of the housing 10 as the lock 13 is deflected into the retracted position.

The front-stop member 14 is mounted at the front end of the housing 10 and is formed with recesses 15 that communicate with the front ends of the cavities 11. Front ends of the properly inserted terminal fittings 30 are accommodated in the recesses 15. The front ends of the recesses 15 define front-stop surfaces 16 for positioning the terminal fittings 30 at their front-limit positions by contacting front ends 30A of the terminal fittings 30.

Two slit-shaped locking spaces 17 are open in the bottom surface of the housing 10 and are substantially continuous at the opposite transverse ends of the retainer accommodating chamber 12. Receiving projections 18F, 18R are formed respectively on the front and rear walls of each locking space 17 and are at substantially the same height. Partial locking receiving surfaces 19F, 19R are formed on the respective receiving projections 18F, 18R and face obliquely forward and down. Full locking receiving surfaces 20F, 20R are formed on the upper surfaces of the receiving projections 18F, 18R and are substantially parallel to the longitudinal direction of the cavities 11.

Each terminal fitting 30 is narrow and long and is formed by bending a metallic material stamped out into a specified shape. A front section of the terminal fitting 30 defines a box 31 that can be connected with an unillustrated mating terminal. A rear section of the terminal fitting 30 defines a wire connecting portion 33 that can be crimped into connection with a wire 32, and a middle section of the terminal fitting 30 is a coupling portion 34 that couples the box 31 and the wire connecting portion 33. An engaging edge 35 is formed by a hole in the bottom of the box 31 and is configured for engagement with the lock 13. The rear end of the box 31 defines a pushable portion 36 for engagement with the retainer 40, and the bottom end of the pushable portion 36 is slanted to form a contact portion 36A.

The front end 30F of the terminal fitting 30 is spaced from the engaging edge 35 along the inserting direction ID by a distance that is slightly less than the distance between the front-stop surface 16 and the front end 13F of the lock 13 when the lock 13 is at the locking position. The lock 13 inclines to the retracted position (chain line in FIG. 6) while the terminal fitting is being inserted into the housing 10, but restores resiliently to the locking position (FIG. 1) when the front end 30F of the terminal fitting 30 contacts the front-stop surface 16. The properly inserted terminal fitting 30 can make slight loose shaking movements along the inserting and withdrawing directions ID of the terminal fitting 30 between a position where the front end 30F of the terminal fitting 30 contacts the front-stop surface 16 and position where the front end 13F of the lock 13 engages the engaging edge 35. However, the lock 13 prevents the terminal fitting 30 from being withdrawn from the cavity 11.

The retainer 40 is adapted to hold the terminal fittings 30 securely in the housing 10. The front surface of the retainer 40 is formed with pushers 41 that correspond to the respective cavities 11 at the upper stage. The retainer 40 also is formed with through holes 42 that correspond to the respective cavities 11 at the lower stage. The through holes 42 have bottom walls, and portions of the bottom walls at the front surface of the retainer 40 define pushers 41 that correspond to the cavities 11 at the lower stage. Slanted contacts 41A are formed on the pushers 41 and are aligned obliquely to both moving direction MD of the retainer 40 and the inserting direction ID of the terminal fittings 30.

Figure 2:
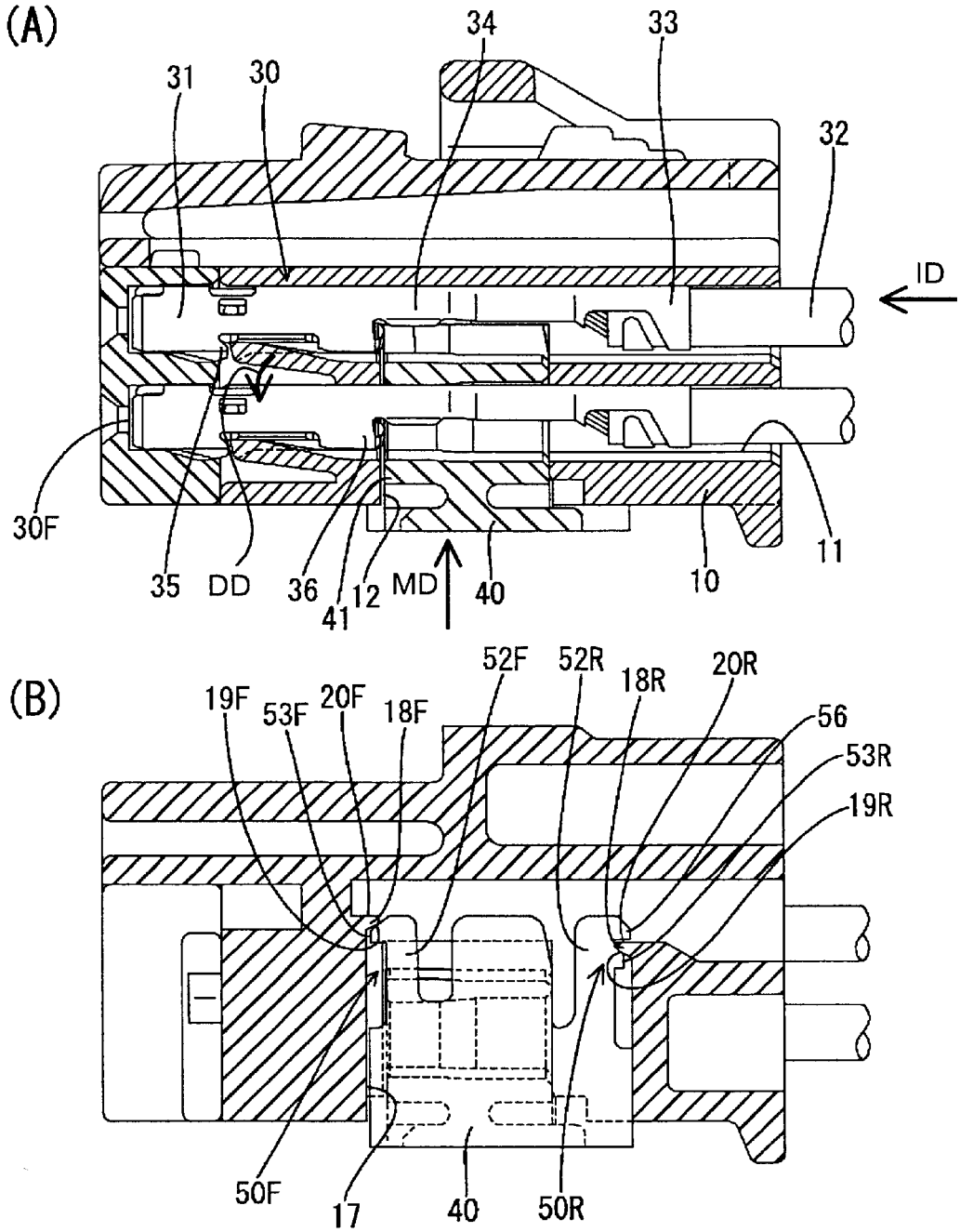
FIG. 2A is a section with the retainer held at a partial locking position.
FIG. 2B is a section with the retainer held at the partial locking position.
Figure 5:
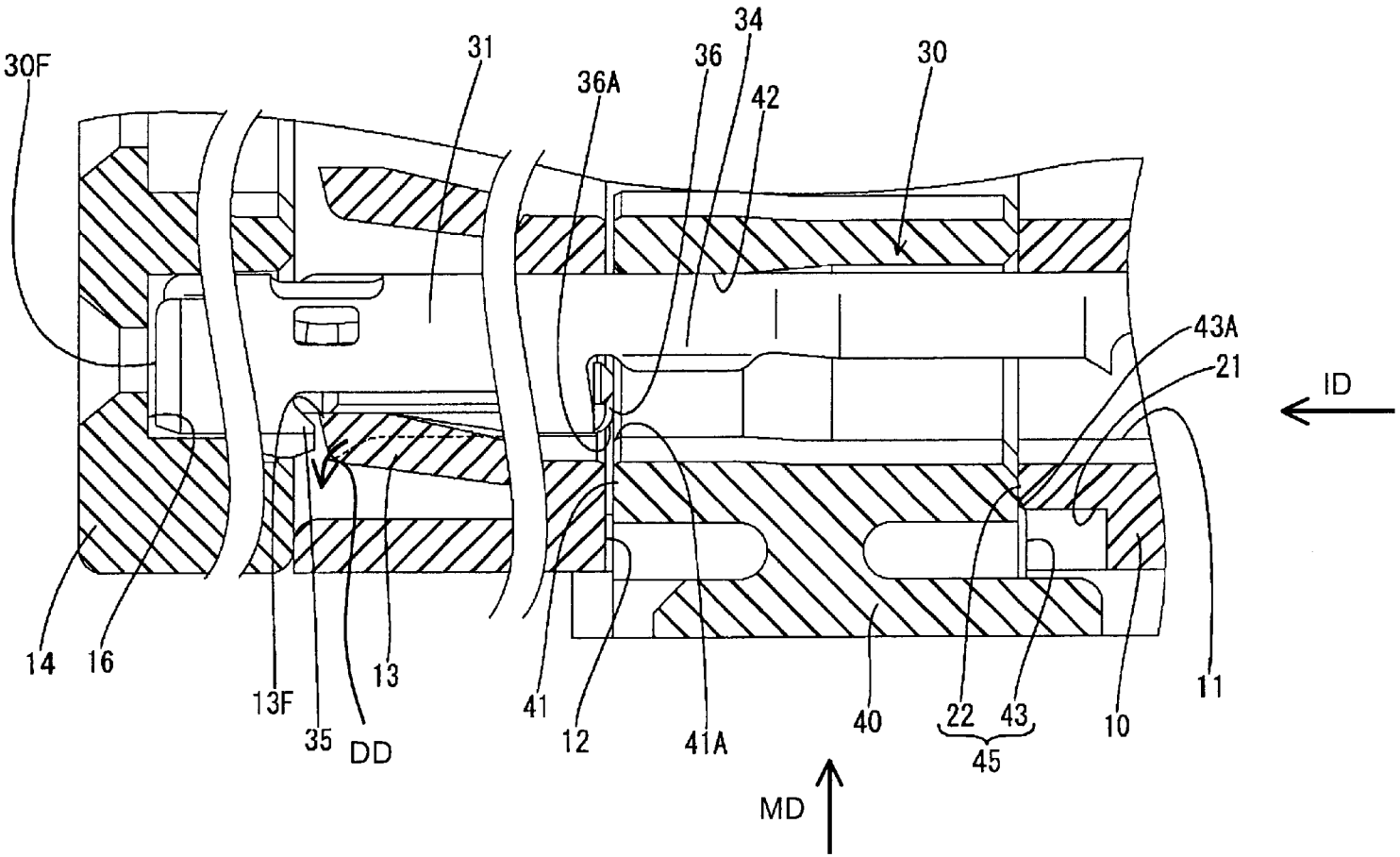
FIG. 5 is a fragmentary enlarged section partly cut away showing a state where the retainer is located at the partial locking position.

Left and right vertical ribs 43 are formed on the rear surface of the retainer 40, and an escaping recess 21 is formed in the rear wall of the retainer accommodating chamber 12 near the bottom opening for avoiding interference with the ribs 43 when the retainer 40 is at a partial locking position (see FIGS. 2, 5). The ribs 43 of the retainer 40 face the escaping recess 21 at the same height when the retainer 40 is at the partial locking position shown in FIG. 5. An area of the rear wall of the retainer accommodating chamber 12 above the escaping recess 21 and below of the cavities 11 of the lower stage defines a rib receiving surface 22, and the ribs 43 face the rib receiving surface 22 at the same height when the retainer 40 is at a full locking position (see FIGS. 3, 6). A dimension between the front wall of the retainer accommodating chamber 12 and the rib receiving surface 22 substantially equals the thickness of the retainer 40, including the ribs 43, along the inserting direction ID. Thus, the retainer 40 can make loose movements in forward and backward directions with respect to the housing 10 while the retainer 40 is at the partial locking position. However, the retainer 40 is prevented from making loose movements in forward and backward directions with respect to the housing 10 while at the full locking position. The ribs 43 of the retainer 40 and the rib receiving surface 22 of the housing 10 form a displacing means 45 for displacing the retainer 40 forward with respect to the housing 10 while the retainer 40 is being moved from the partial locking position to the full locking position.

The housing 10 and the retainer 40 both are provided with two pairs of partial locking means 50F, 50R and two pairs of full locking means 51F, 51R which are arranged at the opposite transverse ends of the retainer 40. These partial and full locking means are described in detail below.

Resilient locks 52F, 52R are cantilevered from at each of the opposite ends of the retainer 40 and are spaced apart in forward and backward directions. A locking projection 53F projects forward from the upper end of each front resilient lock 52F. A partial locking surface 54F is formed on the upper surface of each locking projection 53F and extends oblique to the moving direction MD of the retainer 40 between the partial locking position and the full locking position. A full locking surface 55F is formed on the bottom surface and extends substantially normal to the moving direction MD of the retainer 40. On the other hand, a partial locking projection 56 projects back from the upper end of the rear resilient locking piece 52R, and a locking projection 53R projects back from a location below the partial locking projection 56. A partial locking surface 54R is formed on the upper surface of each locking projection 53R and extends oblique to the moving direction of the retainer 40. A full locking surface 55R is formed on the bottom of each locking projection 53R and extends substantially normal to the moving direction MD of the retainer 40. The front locking projections 53F and the rear locking projections 53R are at approximately the same height along the moving direction MD.

The locking projections 53F, 53R of the retainer 40 and the receiving projections 18F, 18R of the housing 10 form the partial locking means 50F, 50R for preventing the retainer 40 at the partial locking position from moving loosely toward the full locking position, and the full locking means 51F, 51R for preventing the retainer 40 at the full locking position from moving loosely toward the partial locking position.

The retainer 40 is mounted at the partial locking position in the housing 10 (see FIGS. 2 and 5) before the terminal fittings 30 are inserted into the housing 10. The two pairs of front and rear locking projections 53F, 53R and two pairs of front and rear partial locking surfaces 54F, 54R of the retainer 40 contact the receiving surfaces 19F, 19R of the receiving projections 18F, 18R for partial locking of the housing 10 from below in this state. Thus, the retainer 40 is prevented from moving loosely up toward the full locking position. Further, the partial locking projections 56 contact the full locking receiving surfaces 20R of the rear receiving projections 18R from above. Thus, the retainer 40 also is prevented from moving down and out of the housing 10. Additionally, the pushers 41 of the retainer 40 are retracted down and away from the insertion paths of the terminal fittings 30.

The terminal fittings 30 then are inserted in the inserting direction ID into the corresponding cavity 11 from behind. As a result, each lock 13 is deformed resiliently in the deformation direction DD down to the retracted position by the contact with the bottom surface of the box 31 of the terminal fitting 30 during the insertion. The terminal fitting 30 reaches its proper insertion position when the front end 30F thereof substantially contacts the front-stop surface 16. At this point, the front end 13F of the lock 13 disengages from the bottom surface of the box 31. Thus, the lock 13 resiliently restores toward the locking position, and reaches a height substantially corresponding to the engaging edge 35 of the terminal fitting 30. The front end 13F of the lock 13 is displaced backward during the movement of the lock 13 from the retracted position to the locking position. Consequently, a clearance is formed between the front end 13F of the lock 13 and the engaging edge 35 along the inserting direction ID (see FIG. 6). Therefore, the terminal fitting 30 can shake along the inserting direction ID.

Figure 3:
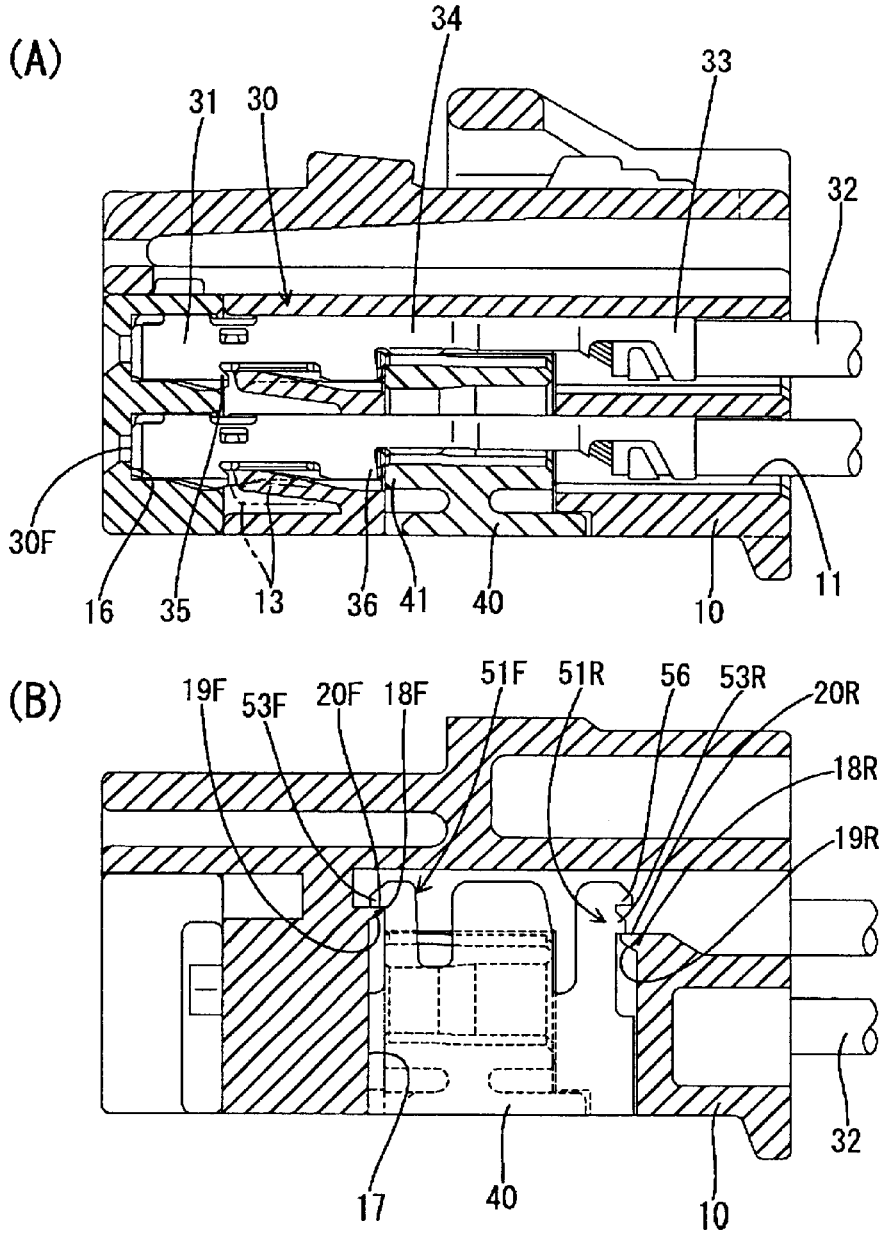
FIG. 3A is a section showing a state where the terminal fittings are locked by the retainer held at a full locking position.
FIG. 3B is a section showing a state where the retainer is held at the full locking position.
Figure 4:
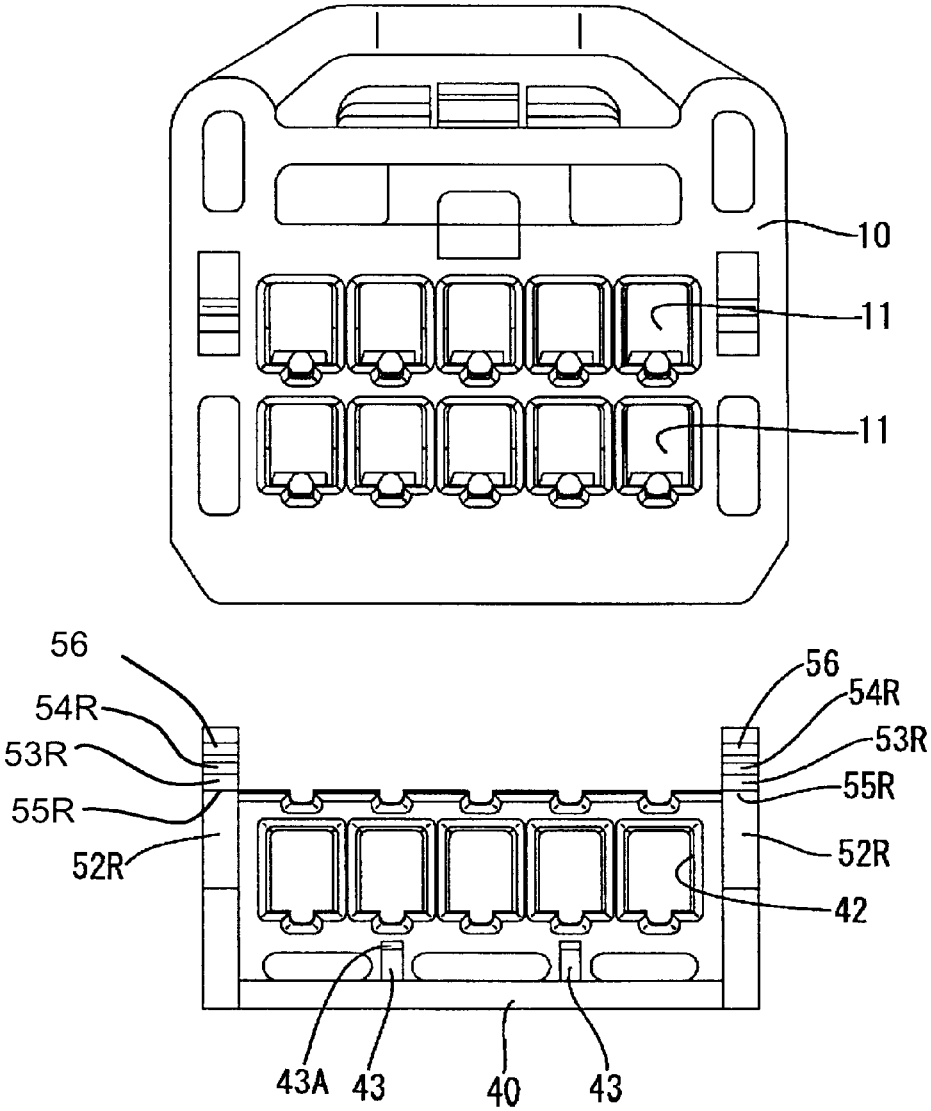
FIG. 4 is a rear view showing a state where the retainer is detached from the housing.
Figure 6:
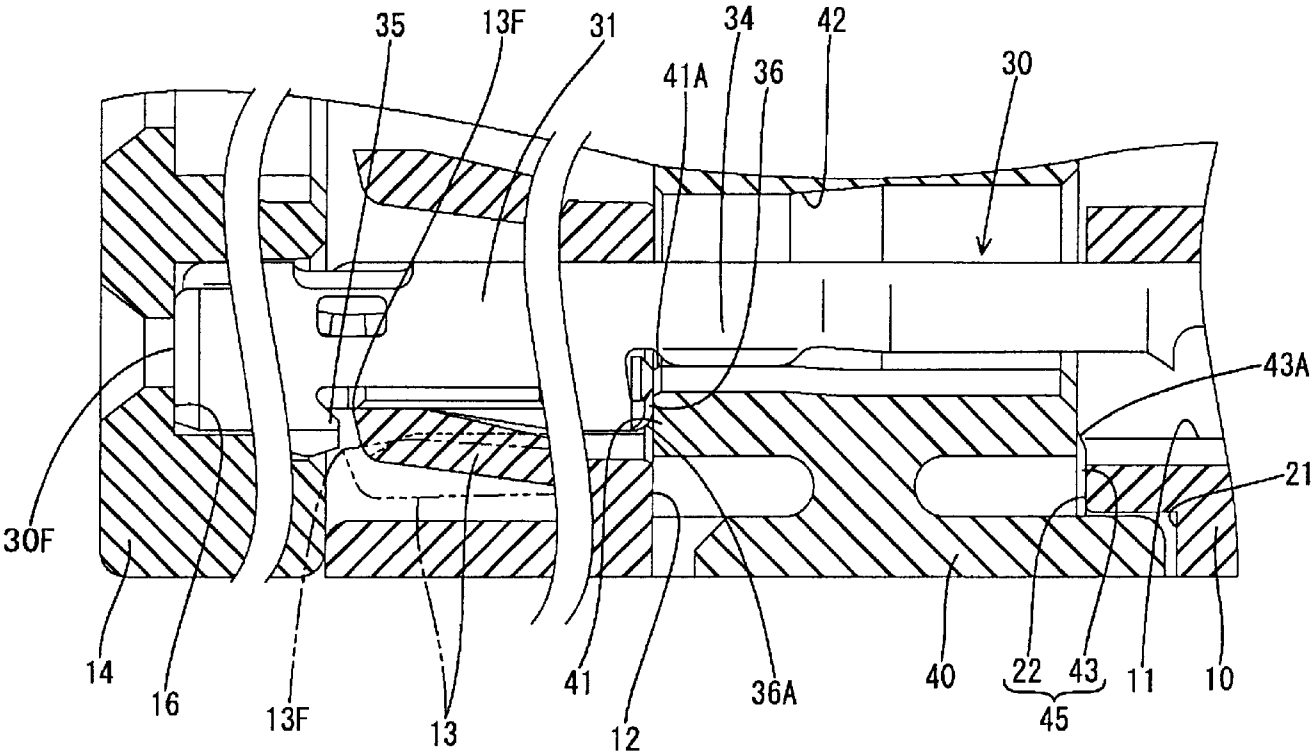
FIG. 6 is a fragmentary enlarged section partly cut away showing a state where the retainer is located at the full locking position.
Figure 7:
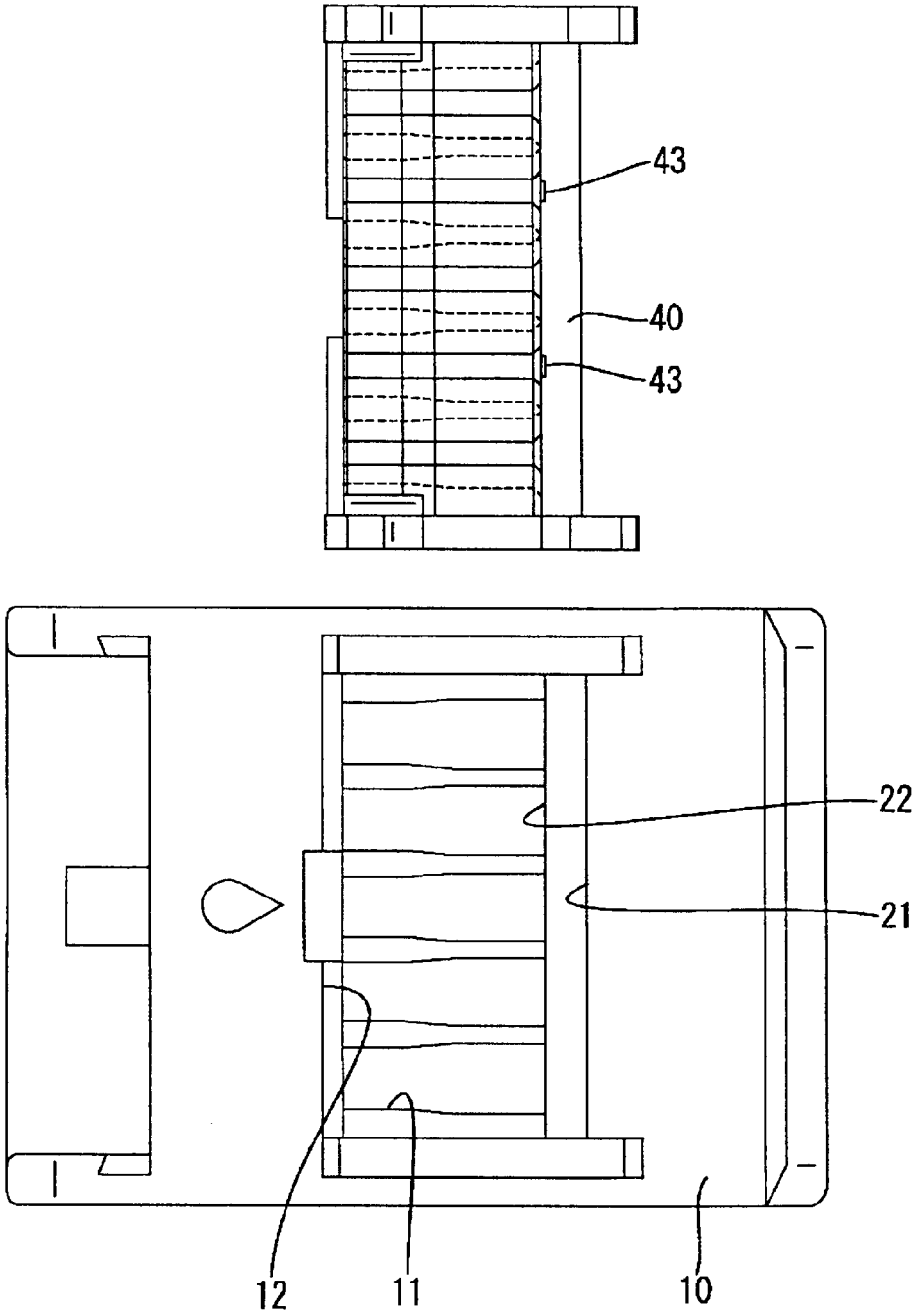
FIG. 7 is a bottom view showing a state where the retainer is detached from and arranged beside the housing.

Next, the retainer 40 is moved in the moving direction MD from the partial locking position to the full locking position (FIGS. 3, 6). As a result, the resilient locks 52F, 52R deform and the partial locking surfaces 54F, 54R disengage from the partial locking receiving surfaces 19F, 19R. The locking projections 53F, 53R then move beyond the receiving projections 18F, 18R, and the front and rear full locking surfaces 55F, 55R engage the full locking receiving surfaces 20F, 20R from above. As a result, the retainer 40 is held at the full locking position.

The ribs 43 align with and engage the rib receiving surface 22 as the retainer is moved to the full locking position. Thus, the retainer 40 is displaced forward. The slanted guide surfaces 43A at the upper ends of the ribs 43 enable the ribs 43 to move smoothly into engagement with the rib receiving surface 22.

The terminal fittings 30 may be at their proper insertion positions when the retainer 40 is moved to the full locking position (see FIG. 6). In this case, the rear surfaces of the pushable portions 36 of the terminal fittings 30 and the front surfaces of the pushers 41 are at the same position along the inserting direction ID. Thus, the pushers 41 slide in contact with the pushable portions 36 from behind without moving the terminal fittings 30 in the inserting direction ID, and the retainer 40 holds the terminal fittings 30 at their proper insertion positions.

On the other hand, the terminal fitting 30 may be behind the proper insertion position (see FIG. 5). In this case, the slanted contacts 36A, 41A formed at the bottom ends of the rear surfaces of the pushable portions 36 and at the upper edges of the front surfaces of the pushers 41 contact each other obliquely. Thus, the pushers 41 push the pushable portions 36 forward by the inclination of the contacts 36A, 41A as the retainer 40 is moved, and the terminal fitting 30 is pushed to the proper insertion position when the retainer 40 reaches the full locking position.

The connector of this embodiment has the following effects.

The front end 30F of each properly inserted terminal fitting 30 contacts the corresponding front-stop surface 16. However, a clearance exists between the engaging edge 35 and the front end 13F of the lock 13. Thus, the terminal fitting 30 is permitted to shake in forward and backward directions. The retainer 40 can be moved from the partial locking position to the full locking position while being displaced forward. Thus, the pushers 41 of the retainer 40 contact the properly inserted terminal fittings 30 and hold the terminal fittings 30 at their proper insertion positions. Thus, the terminal fittings 30 are prevented from shaking when the retainer 40 is held at the full locking position.

The terminal fitting 30 could be rearward of the proper insertion position as the retainer 40 is being moved to the full locking position. In this case, the slanted contacts 36A, 41A engage and push the retainer 40 forward and hence push the terminal fitting 30 toward the proper insertion position. Thus, movement of the retainer 40 to the full locking position is not hindered.

The retainer 40 is displaced forward in the inserting direction ID while being moved in the moving direction MD from the partial locking position to the full locking position. Thus, movement of the retainer 40 from the partial locking position to the full locking position allows the retainer 40 to move the terminal fitting 30 towards its proper position. The displacing direction (ID) of the retainer increases engaging areas of the front receiving projections 18F and the locking projections 53F. The engaging areas of the full locking receiving surfaces 20 and the full locking surfaces 55F are larger than those of the partial locking receiving surfaces 19F and the partial locking surfaces 54F. Thus, the retainer 40 can be held reliably at the full locking position.

The retainer 40 moved to the full locking position does not shake along the inserting direction ID because the ribs 43 contact the rib receiving surfaces 22 and the pushers 41 contact the terminal fittings 30 at their front-limit positions. Therefore, there is no possibility of disengaging the full locking surfaces 55F, 55R from the receiving surfaces 20F, 20R for full locking due to shaking of the retainer 40 in forward and backward directions.

At least two pairs of front and rear partial locking means 50F, 50R are provided. Thus, a partial locking function can be effected more reliably as compared to connectors with one pair of partial locking means. Similarly, at least two pairs of front and rear full locking means 51F, 51R are provided, and a full locking function can be effected more reliably as compared to connectors with only one pair of full locking means.

The partial locking means 50F, 50R are at two positions spaced apart in forward and backward directions. Thus, the retainer 40 can be oriented stably at the partial locking position. Further, the two partial locking means 50F, 50R are at substantially the same position with respect to vertical direction, there is no possibility that the retainer 40 is inclined with respect to forward and backward directions at the partial locking position.

Similarly, the full locking means 51F, 51R are at two or more positions spaced apart in forward and backward directions. Thus, the retainer 40 can be oriented stably at the full locking position. Further, the two full locking means 51F, 51R are at substantially the same position with respect to the vertical direction. Thus, there is no possibility that the retainer 40 is inclined with respect to forward and backward directions at the full locking position.

The locking projections 53F, 53R on the retainer 40 function both as the partial locking portions and as the full locking portions. Thus, the retainer 40 has a simpler shape than those with partial and full locking portions are separate. Similarly, the receiving projections 18F, 18R in the housing 10 function both as the receiving portions for partial locking and as the receiving portions for full locking. Thus, the housing 10 has a simpler shape than those with partial and full locking portions are separate.

The present invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The locks for locking the terminal fittings are resin locks formed in the housing in the foregoing embodiment. However, the terminal fittings may be locked by metallic locks formed by bending cut portions of the terminal fittings.

Both the pushers and the pushable portions are provided with the slanted contacts in the foregoing embodiment. However, only either the pushers or the pushable portions may be provided with the contacts.

Although the terminal fittings are female terminal fittings in the foregoing embodiment, they may be male terminal fittings.

In the foregoing embodiment, the retainer is displaceable in forward and backward directions when at the partial locking position and is displaced forward when moved from the partial locking position to the full locking position. However, the retainer may be prevented from displacing in forward and backward directions with respect to the housing when at the partial locking position, and the pushers of the retainer may engage the terminal fittings to hold them at their proper insertion positions after the retainer is moved to the full locking position without being displaced forward.

Although two stages of terminal fittings are provided, one or more than two stages may be provided.

What is claimed is:

1. A connector comprising a housing, at least one terminal fitting configured for insertion into the housing along an insertion direction, at least one lock configured for displacement at an angle to the insertion direction during insertion of the terminal fitting, the lock further being configured for engaging behind the terminal fitting when the terminal fitting reaches a proper insertion position to prevent withdrawal of the terminal fitting while permilling some movement of the terminal fitting along the insertion direction, a retainer mounted in the housing at a partial locking position such that the retainer such that the retainer is loosely movable along the insertion direction and permits insertion of the terminal fitting into the housing, the retainer further being movable in a moving direction substantially normal to the insertion direction and into a full locking position in the housing, wherein:

the retainer and the housing are formed with surfaces that interengage as the retainer is pushed along the moving direction from the partial locking position to the full locking position, the surfaces being aligned for displacing the retainer along the insertion direction as the retainer is pushed along the moving direction from the partial locking position to the full locking position; and wherein the retainer comprises at least one pusher (44) engageable with the terminal fitting as the retainer is moved to the full locking position for pushing the terminal fitting to the proper insertion position and holding the terminal fitting in the housing at its proper insertion position.

2. The connector of claim 1, wherein:

the housing comprises a rearwardly projecting receiving projection having a partial locking receiving surface and a full locking receiving surface, the retainer comprises a forwardly projecting locking projection having a partial locking surface and a full locking surface, loose movement of the retainer from the partial locking position toward the full locking position being prevented by the contact of the partial locking surface with the partial locking receiving surface, and loose movement of the retainer from the full locking position toward the partial locking position being prevented by the contact of the full locking surface with the full locking receiving surface.

3. The connector of claim 1, wherein the retainer is configured to make loose movements substantially along the terminal insertion direction with respect to the housing when arranged in the partial locking position, whereas the retainer is substantially prevented from loose movements when in the full locking position.

4. The connector of claim 1, wherein paired spaced apart partial locking means are provided at opposite ends of the retainer with respect to a direction normal to the terminal inserting direction, the partial locking means having partial locking portions for engaging partial locking receiving portions of the housing and preventing the retainer at the partial locking position from moving loosely toward the full locking position.

5. The connector of claim 4, wherein paired spaced apart full locking means are provided at opposite ends of the retainer with respect to a direction normal to the terminal inserting direction, the full locking means having full locking portions for engaging full locking receiving portions of the housing and preventing the retainer at the full locking position from moving loosely toward the partial locking position.

6. The connector of claim 5, wherein at least one of the partial looking means and the full locking means comprise at least pairs.

7. The connector of claim 5, wherein at least one of the partial locking means and the full locking means are provided at two positions spaced apart in a direction substantially parallel with the terminal inserting direction.

* * * * *